US009302740B2

(12) United States Patent
O'Neal et al.

(10) Patent No.: US 9,302,740 B2
(45) Date of Patent: Apr. 5, 2016

(54) EXTENDABLE MULTIHULL BOAT

(71) Applicants: Michael O'Neal, Farmington, MO (US); Blaine Lawson, Farmington, MO (US)

(72) Inventors: Michael O'Neal, Farmington, MO (US); Blaine Lawson, Farmington, MO (US)

(73) Assignee: Quadratoon Company LLC, Farmington, MO (US)

( * ) Notice: Subject to any disclaimer, the term of this patent is extended or adjusted under 35 U.S.C. 154(b) by 0 days.

(21) Appl. No.: 14/102,122

(22) Filed: Dec. 10, 2013

(65) Prior Publication Data

US 2014/0165893 A1 Jun. 19, 2014

Related U.S. Application Data

(60) Provisional application No. 61/898,373, filed on Oct. 31, 2013, provisional application No. 61/737,245, filed on Dec. 14, 2012.

(51) Int. Cl.

| | |
|---|---|
| ***B63B 1/10*** | (2006.01) |
| ***B63B 1/14*** | (2006.01) |
| *B63B 29/02* | (2006.01) |

(52) U.S. Cl.

CPC . *B63B 1/14* (2013.01); *B63B 29/02* (2013.01); *B63B 2001/145* (2013.01); *B63B 2029/022* (2013.01)

(58) Field of Classification Search

CPC ..... B63B 1/14; B63B 2027/141; B63B 1/125
USPC ..... 114/39.26, 61.15, 360, 258, 248
See application file for complete search history.

(56) References Cited

U.S. PATENT DOCUMENTS

| | | | | |
|---|---|---|---|---|
| 3,019,755 | A | 2/1962 | Diamond | |
| 3,300,894 | A | 1/1967 | Glass | |
| 3,613,315 | A | 10/1971 | Sturm | |
| 3,614,937 | A | 10/1971 | Schulman | |
| 3,767,193 | A | 10/1973 | Johnson | |
| 3,858,541 | A | 1/1975 | Metcalf, Jr. | |
| 3,877,095 | A | 4/1975 | Ivy | |
| 3,925,837 | A | 12/1975 | Miller | |
| 4,762,078 | A | 8/1988 | Palmer, Jr. | |
| 4,842,735 | A | 6/1989 | Hollis | |
| 4,909,169 | A | 3/1990 | Skandaliaris | |
| 4,971,315 | A | 11/1990 | Rector | |
| 4,981,100 | A | 1/1991 | Bergeron | |
| 4,993,341 | A | 2/1991 | Merkel | |
| 5,085,164 | A | 2/1992 | Whitton | |
| 5,085,165 | A | 2/1992 | Reed | |
| 5,628,274 | A * | 5/1997 | Biedenweg et al. | 114/362 |
| 6,003,458 | A | 12/1999 | Valliere | |
| 6,041,730 | A * | 3/2000 | Oliverio et al. | 114/294 |
| 6,058,866 | A | 5/2000 | May | |
| 6,298,801 | B1 | 10/2001 | May | |
| 6,868,799 | B2 * | 3/2005 | Wright | 114/343 |
| 6,874,440 | B1 | 4/2005 | Manderfeld | |

(Continued)

*Primary Examiner* — S. Joseph Morano
*Assistant Examiner* — Andrew Polay
(74) *Attorney, Agent, or Firm* — CreatiVenture Law, LLC; Dennis JM Donahue, III

(57) ABSTRACT

A motorized or manual extendable and retractable floating device is supported longitudinally by one or more floatation devices. The flotation deck is stored and supported by tracks or rails from beneath and between an upper deck of a houseboat, pontoon boat, tritoon boat, catamaran, floating dock, pier-supported dock or other watercraft or dock. When fully extended, the floating deck will remain attached to the watercraft, and additional width may be achieved with extendable or fold out sides or wings.

20 Claims, 12 Drawing Sheets

(56) References Cited

U.S. PATENT DOCUMENTS

| | | | | |
|---|---|---|---|---|
| 7,028,632 | B2 | 4/2006 | Blank | |
| 7,162,969 | B2 | 1/2007 | Houlder | |
| 7,536,966 | B2 | 5/2009 | Stryjewski | |
| 7,628,115 | B2 | 12/2009 | Thompson | |
| 7,987,803 | B2 * | 8/2011 | Cochran | 114/258 |
| 8,056,496 | B1 | 11/2011 | Bussa | |
| 2005/0236835 | A1 * | 10/2005 | Williams | E21B 33/085 285/361 |

* cited by examiner

EXTENDABLE MULTIHULL BOAT

CROSS-REFERENCE TO RELATED APPLICATIONS

This application is a utility application claiming the benefit of provisional patent application No. 61/737,245 filed Dec. 14, 2012, which is hereby incorporated by reference.

STATEMENT REGARDING FEDERALLY SPONSORED RESEARCH

Not Applicable.

APPENDIX

Not Applicable.

BACKGROUND OF THE INVENTION

1. Field of the Invention

The present invention relates to multihull boats, and more particularly to multihull boats with an extendable platform.

2. Related Art

There have been many alternative designs that seek to increase the deck space for watercraft on pontoons, including laterally extending decks and longitudinally extending decks. When extending the deck space longitudinally using a ramp, many prior art ramps do not provide any buoyancy to the section of the ramp being extended and others may have negligible buoyancy and slope downward and dip to near water level or at the water level, allowing sections of the deck to be splashed and get wet. Further, such ramps are unstable, particularly in rough weather or choppy water.

The present invention provides an increase in deck space by extending a lower deck longitudinally, while also providing additional longitudinal buoyancy that maintains the elevation of the lower deck above the surface of the water in a near parallel arrangement to the main deck and avoiding the sloping of the lower deck to water level. The increased buoyancy for the lower deck compensates for the increased structure being supported, which stabilizes the lower deck, even in rough waters. The extended space does not slope toward the water, providing a stable, safe surface to sit, walk or stand.

There are a number of different designs for boats with longitudinally extending decks. As an example of a longitudinally extending deck with a flotation device, U.S. Pat. No. 6,868,799 discloses an extendable ramp with a small cylindrical float located at the end of the ramp. The ramp slopes toward the water and the end of the ramp is essentially level with the water. This patent clearly teaches away from the present invention that provides longitudinal buoyancy to lift the deck and provide stability. As an example of a longitudinally extending deck without any flotation device, U.S. Pat. No. 8,056,496 discloses an extendable deck for a pontoon boat that is stowed under the main deck. The extendable deck has no flotation devices attached, but is levered from the bow of the boat. As the deck is extended beyond its half retracted position, the end of the floating deck begins sloping down and the deck designed to require support by a beach or a boat dock when it is fully extended. This patent likewise teaches away from the claimed invention having longitudinal buoyancy and its resulting stability and safety.

None of the prior art references discloses a secondary deck that is buoyantly supported by pontoons or any other flotation device when the secondary deck is stowed beneath the main deck to which the secondary deck is slidably connected. In addition to providing extra deck space, a secondary deck that has its own buoyant support that is operative when the deck is stowed and when the deck is extended can provide increased stability to the watercraft while maintaining the loading capacity of the watercraft. Known watercraft that merely add slidable planks, ramps or decks which do not offset the weight of these features with an increase in the buoyancy of the watercraft necessarily increase the total weight and therefore reduce the loading capacity of the watercraft. When a float on a ramp is only operable when the ramp is deployed, there is no increase in the buoyancy of the watercraft when the ramp is stowed and this can reduce the stability of the watercraft if the ramp is added to an existing watercraft design. Even if the abeam pontoons are sized larger to accommodate the addition of a ramp, the extension of a ramp that is not supported while it is stowed will necessarily produce a cantilevering effect that will increase the stress on the main deck structure and will also change the boat's attitude in the water while the ramp is cantilevered.

SUMMARY OF THE INVENTION

An upper deck is supported on a bottom side by one or more abeam pontoons or a pier structure. A lower deck is located beneath the upper deck, and the decks are slidably connected through a pair of longitudinally elongated guides that are fixedly connected to the bottom side of the upper deck between the abeam pontoons or the piers. The lower deck and has a stowed position underneath the upper deck and an extended position out from underneath the upper deck. Longitudinal buoyancy is provided the lower deck by means of amidships pontoons.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings which are described in the detailed description below.

DETAILED DESCRIPTION OF THE PREFERRED EMBODIMENTS

Figure 1A:
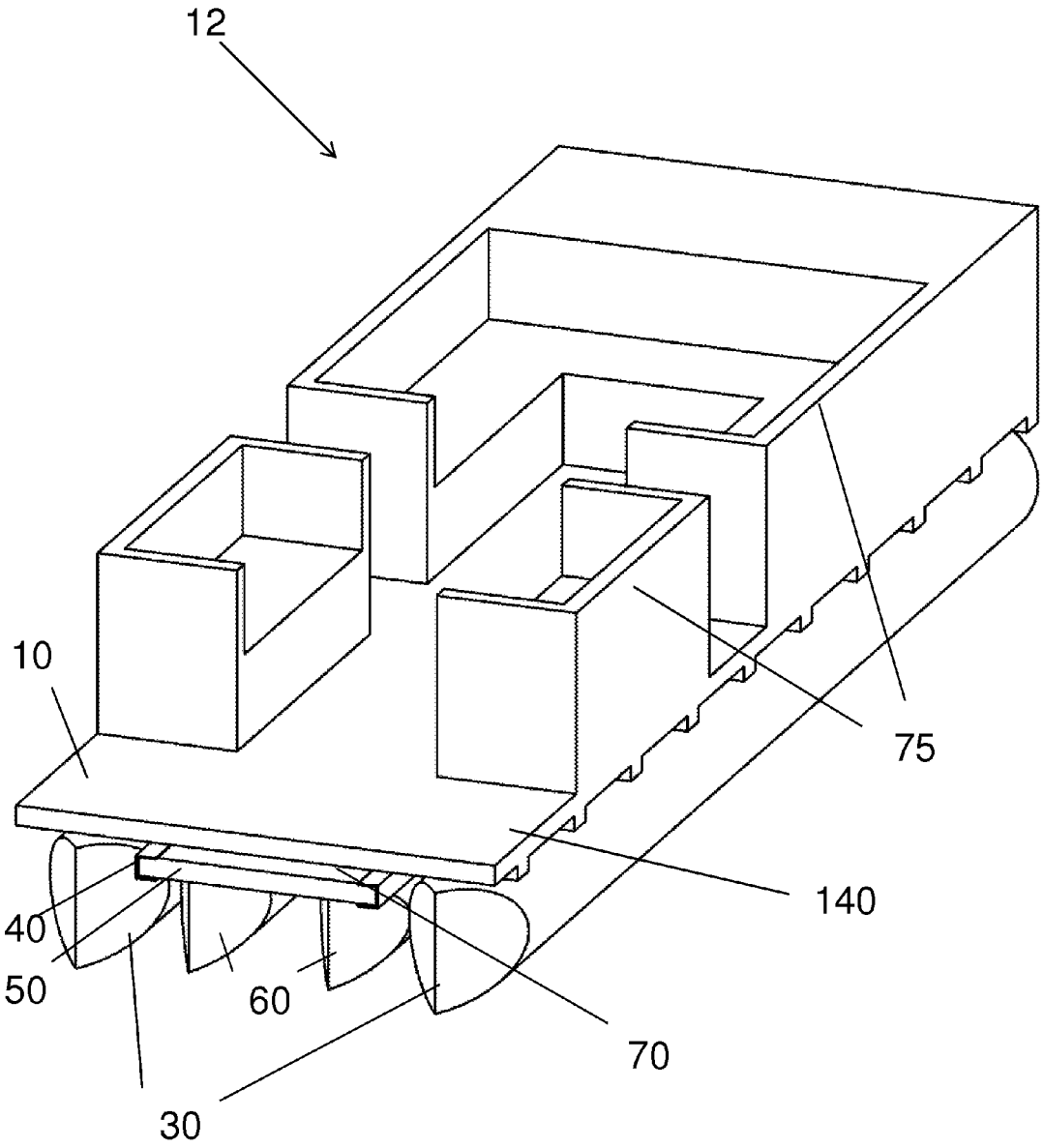
FIGS. 1*a* and 1*b* are downward isometric views of an embodiment of the pontoon boat of the present invention having two amidships pontoons in the stowed and extended positions, respectively.
Figure 1B:
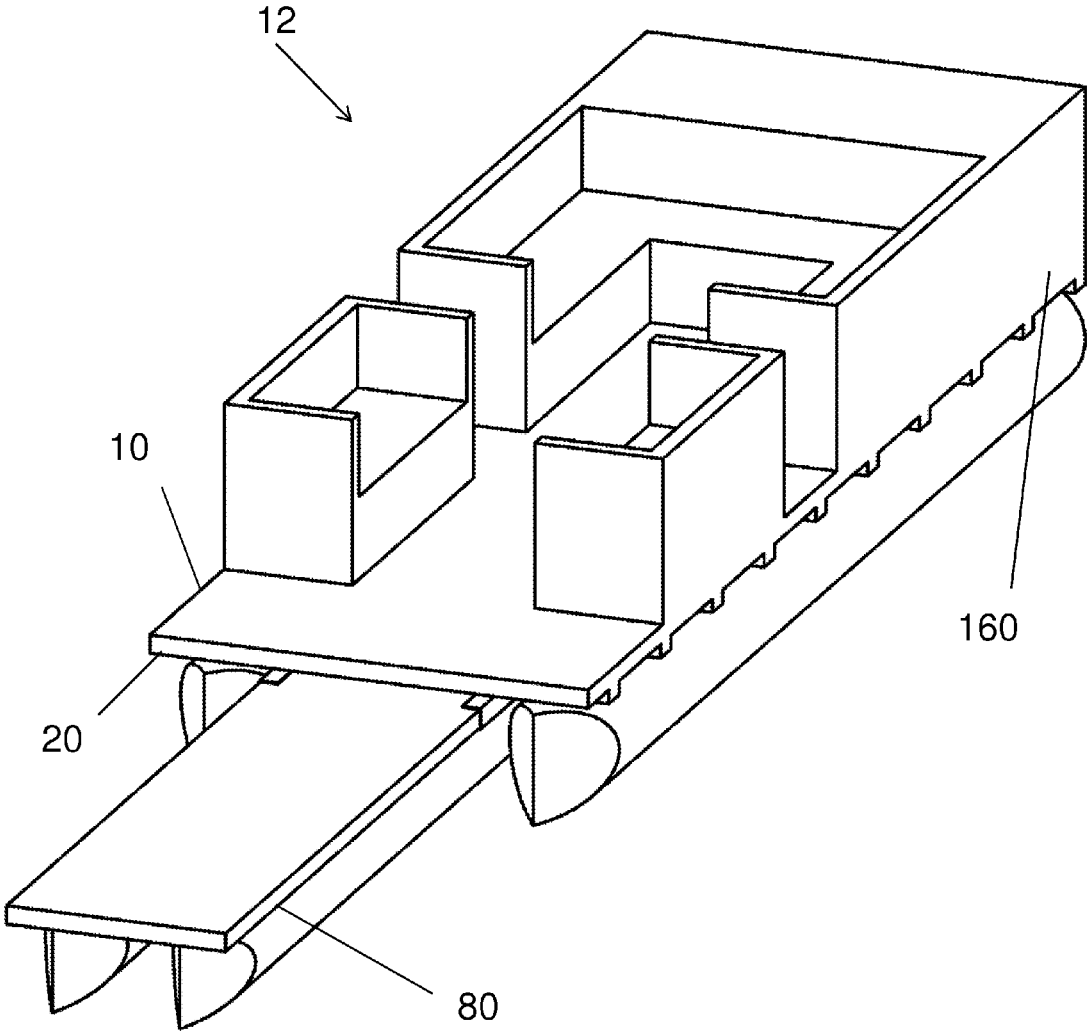

The following description of the preferred embodiment(s) is merely exemplary in nature and is in no way intended to limit the invention, its application, or uses.

As generally shown in FIGS. 1*a*, 1*b*, 2*a*, 2*b*, and 2*c*, a multihull boat 12 has a main, upper deck 10 and a secondary, lower deck 50 and a pair of elongated guide rails 40 connecting the secondary deck to the main deck in a sliding arrangement. The upper deck is supported on its bottom side 20 by a pair of abeam pontoons 30 or other buoyancy devices that extend longitudinally along the length of the upper deck. The guide rails are preferably fixed to the bottom side 20 of the upper deck and are generally parallel to the longitudinally elongated abeam pontoons 30. The lower deck is preferably supported by at least one amidships pontoon 60 that is longitudinally arranged 62 and positioned between the abeam pontoons 30. Preferably, two amidships pontoons 60 are used. The amidships pontoons are preferably at least half as long as the lower deck. Preferably, they are at least 75% as long as the lower deck, and in the preferred embodiment they have the same length as the lower deck. The at least one amidships pontoon 60 provides longitudinal buoyancy to the lower deck, so that the extended deck is elevated above the level of the water and is stabilized against rough or choppy weather. In one embodiment, seats 75 are mounted on the upper deck.

Figures 2A, 2B, 2C:
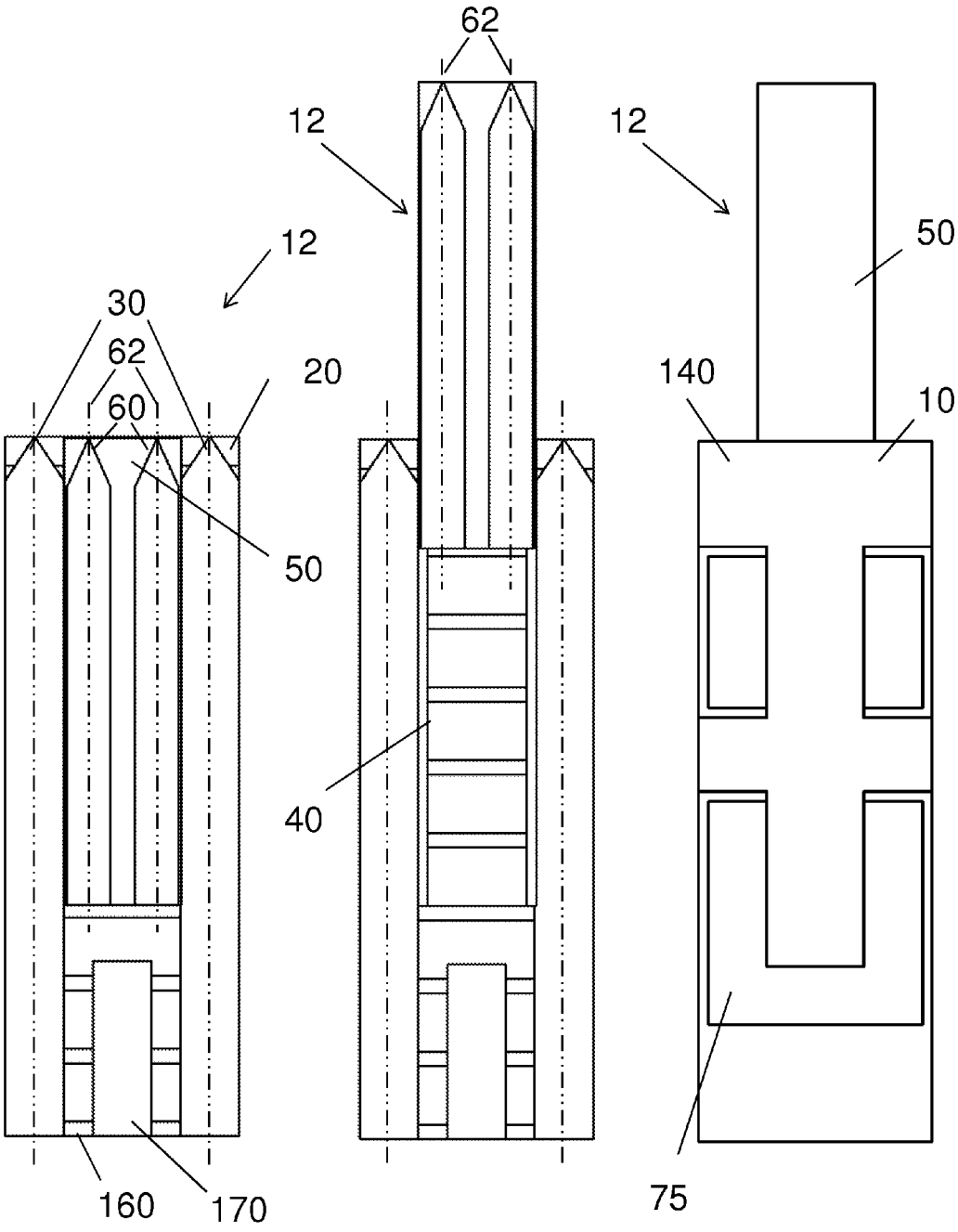
FIGS. 2*a* and 2*b* are bottom plan views of the invention shown in FIGS. 1*a* and 1*b*, respectively.
FIG. 2*c* is a top plan view of the invention shown in FIGS. 1*b* and 2*b*.

As shown in FIGS. 1*a* and 2*a*, in its stowed or retracted position 70, the secondary deck 50 is located substantially beneath the main deck 10, and its amidships pontoons extend longitudinally between the abeam pontoons beneath the lower deck and the upper deck. In its extended position 80, shown in FIGS. 1*b* and 2*b*, the lower deck and the amidships pontoons slide out on the guides to extend longitudinally out from the upper deck's bow and the abeam pontoons. The increased deck space provided by the extension of the secondary deck 50 is shown in FIG. 2*c*.

Figure 3A:
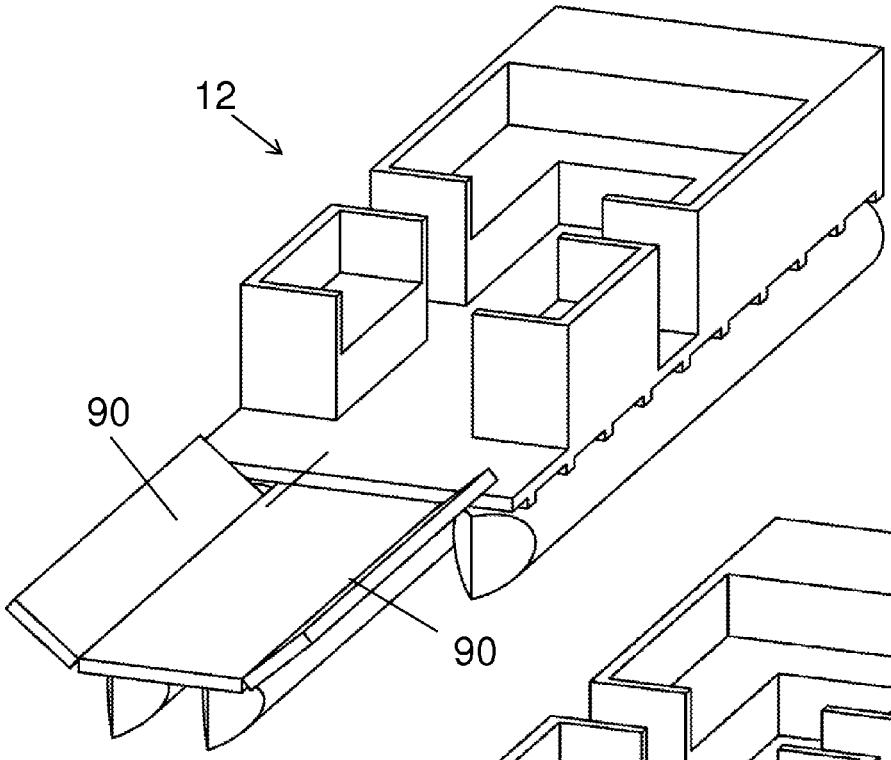
FIGS. 3*a* and 3*b* are downward isometric views of an embodiment of the present invention in the extended position with foldable wings partially and fully unfolded, respectively.
Figure 3B:
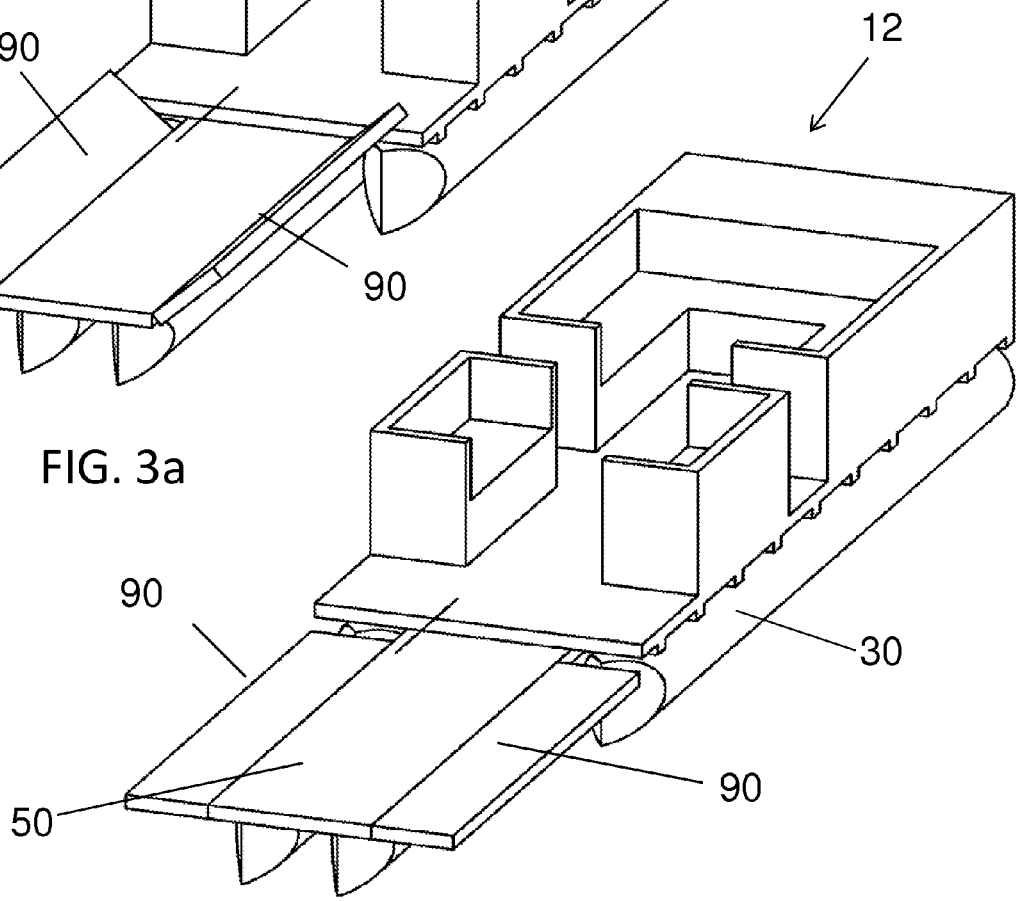
Figure 4A:
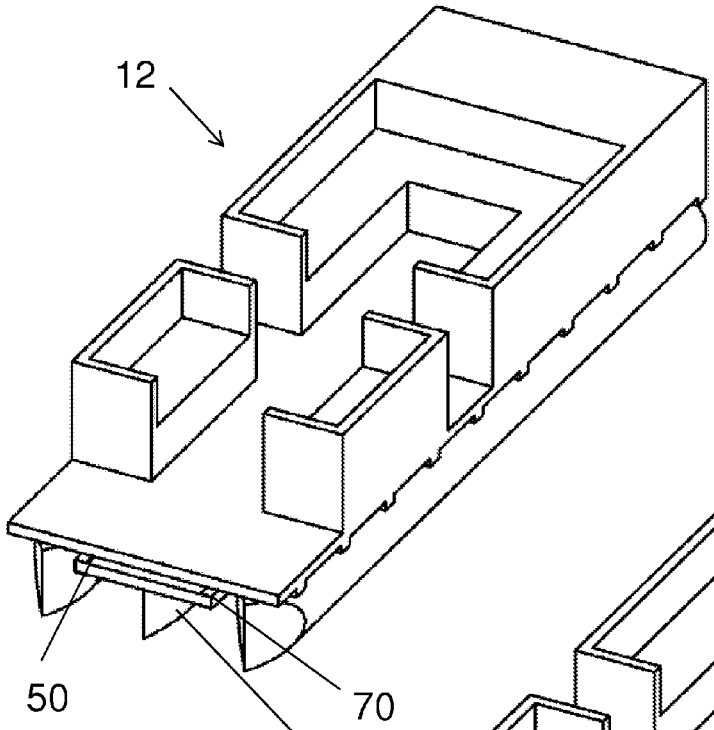
FIGS. 4*a* and 4*b* are downward isometric views of an embodiment of the pontoon boat having a single amidships pontoon in the stowed and extended positions, respectively.

As shown in FIGS. 3*a* and 3*b*, the lower deck 50 can have at least one flip-out or otherwise foldable wing 90 that extends along both sides of the lower deck. Preferably, the lower deck has two foldable wings 90 as shown in FIG. 4*a*. The wings can be laterally folded over the lower deck in a closed position so that the wings are located between the lower deck and the upper deck when the lower deck is stowed. The wings can be rotated out into an open position after the lower deck is extended to increase the lower deck space by 50% or more. Deck extensions, such as the flip-out wings, may be applied by folding out additional decking material, running parallel on one or both sides partially or the full length of the existing lower deck. The foldable extensions can be supported and stabilized by protective coated brackets or cables. It will also be appreciated that it is possible that the side extensions may be further supported by an optional truss that may also be extended from a stowed position under the upper deck. In one embodiment the wings are manually opened and closed, although it will be appreciated that an actuation system could be used to mechanize the folding and unfolding operations. Additionally, the foldable structures could be railings. It is also possible that the ends of the wings may include foldable railings that can be unfolded when the wings are unfolded.

Figure 4B:
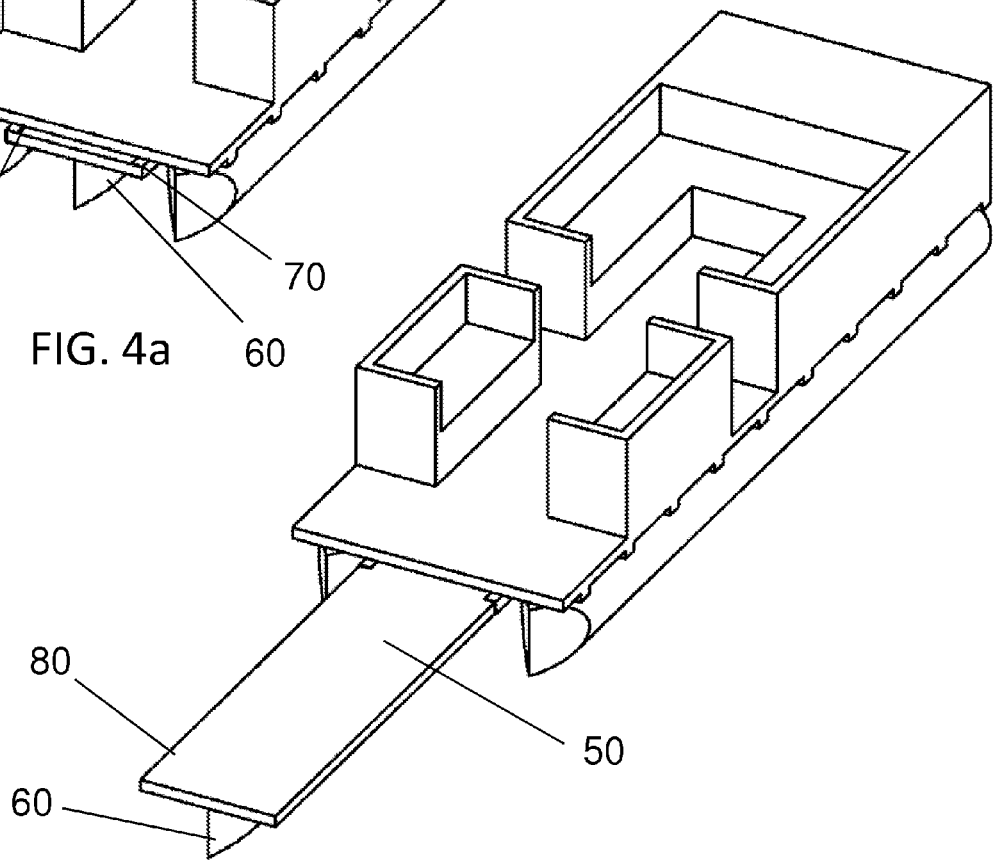

The increased buoyancy and stability of multiple amidships pontoons for the lower deck may be particularly beneficial for the foldable wings' additional weight and cantilevered structure. However, as shown in FIGS. 4*a* and 4*b*, it is also possible to use a single amidships pontoon to support the lower deck. It will be appreciated that the size of the single or multiple amidships pontoons may be the same size as the abeam pontoons or they can be a different size and possibly a different shape to better support the lower deck and to fit within the space below the upper deck.

Figure 5A:
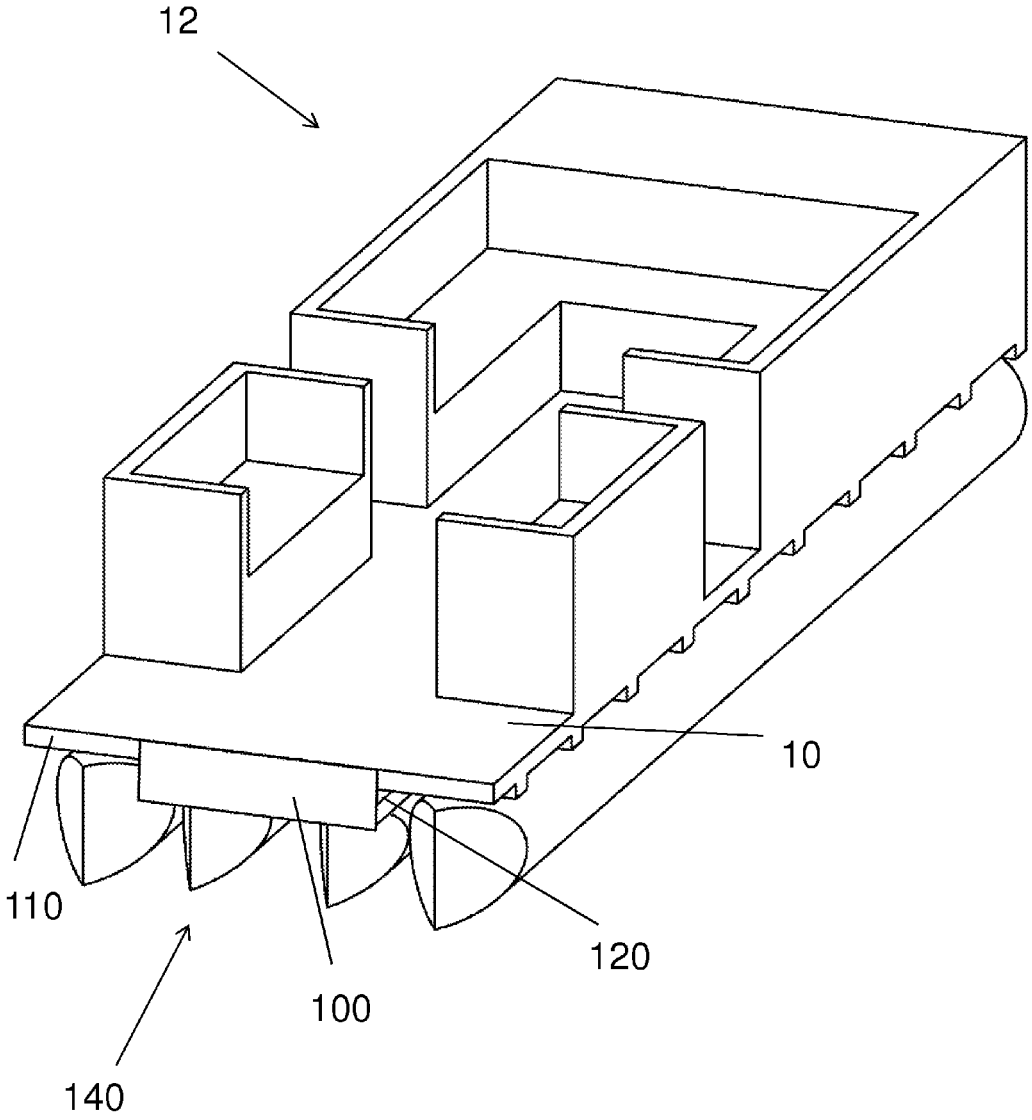
FIG. 5*a* is a downward isometric view of an embodiment of the pontoon boat of the present invention in the retracted position with a hinge plate.
Figure 5B:
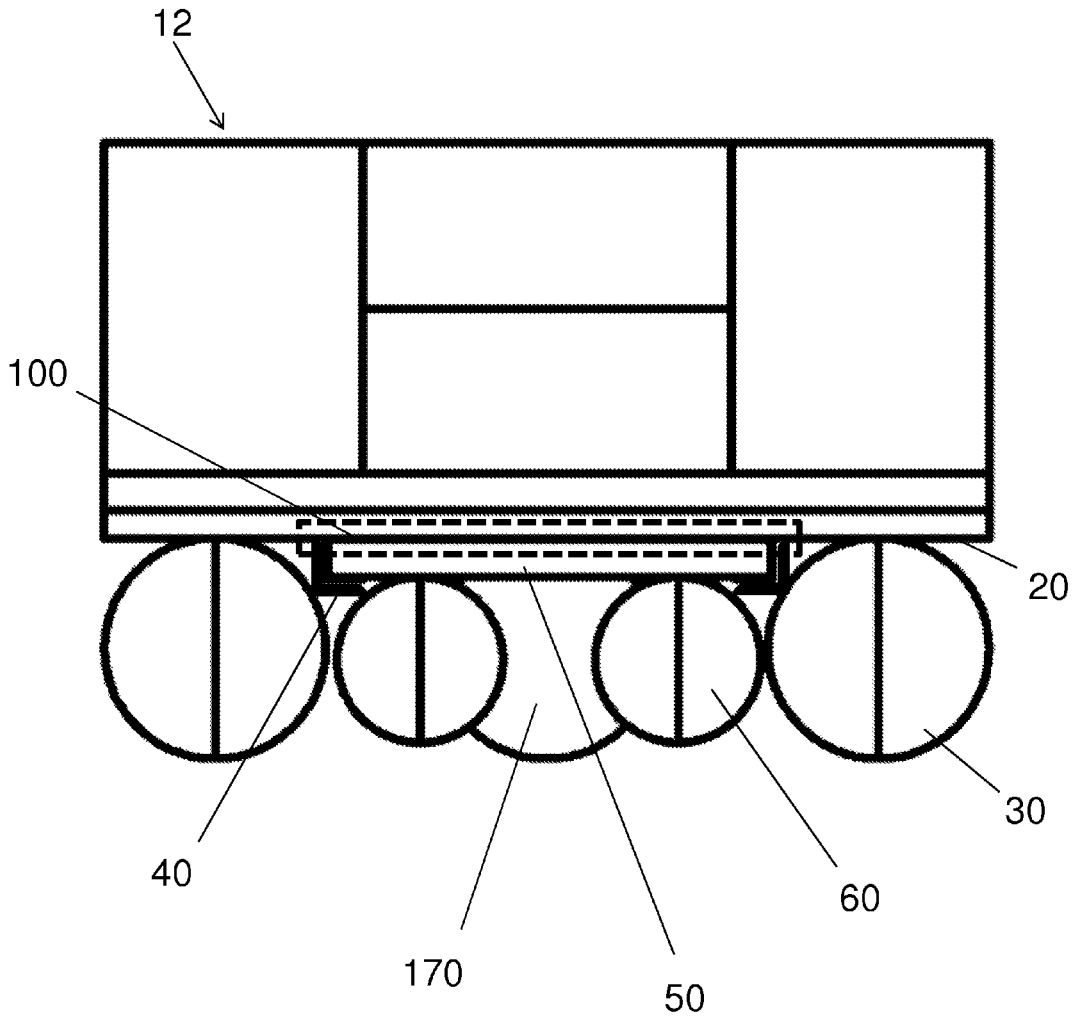
FIG. 5*b* is a bow end view of the boat shown in FIG. 5*a*.

As shown in FIGS. 5*a* and 5*b*, the upper deck 10 may also have a rotatable hinge plate 100 extending from the front face of the upper deck 110 on its bow 140 to the top side 120 of the lower deck's surface. The hinge plate is a safety protection feature which helps to ensure the safety of passengers from the different deck levels when the lower deck is extended as well as when it is moving between its stowed and extended positions. The dimensions of the hinge plate could be three (3) or more inches wide and preferably spans the width of the lower deck. As another safety feature, the lower deck preferably has white anchor lights mounted to its front to ensure safe use at night when the lower deck is extended. Other features may be added such to the lower deck, such as ladders, cup holders, spring boards, table bases and other accessories that are typically found on pleasure vessels and watercraft.

Figure 6:
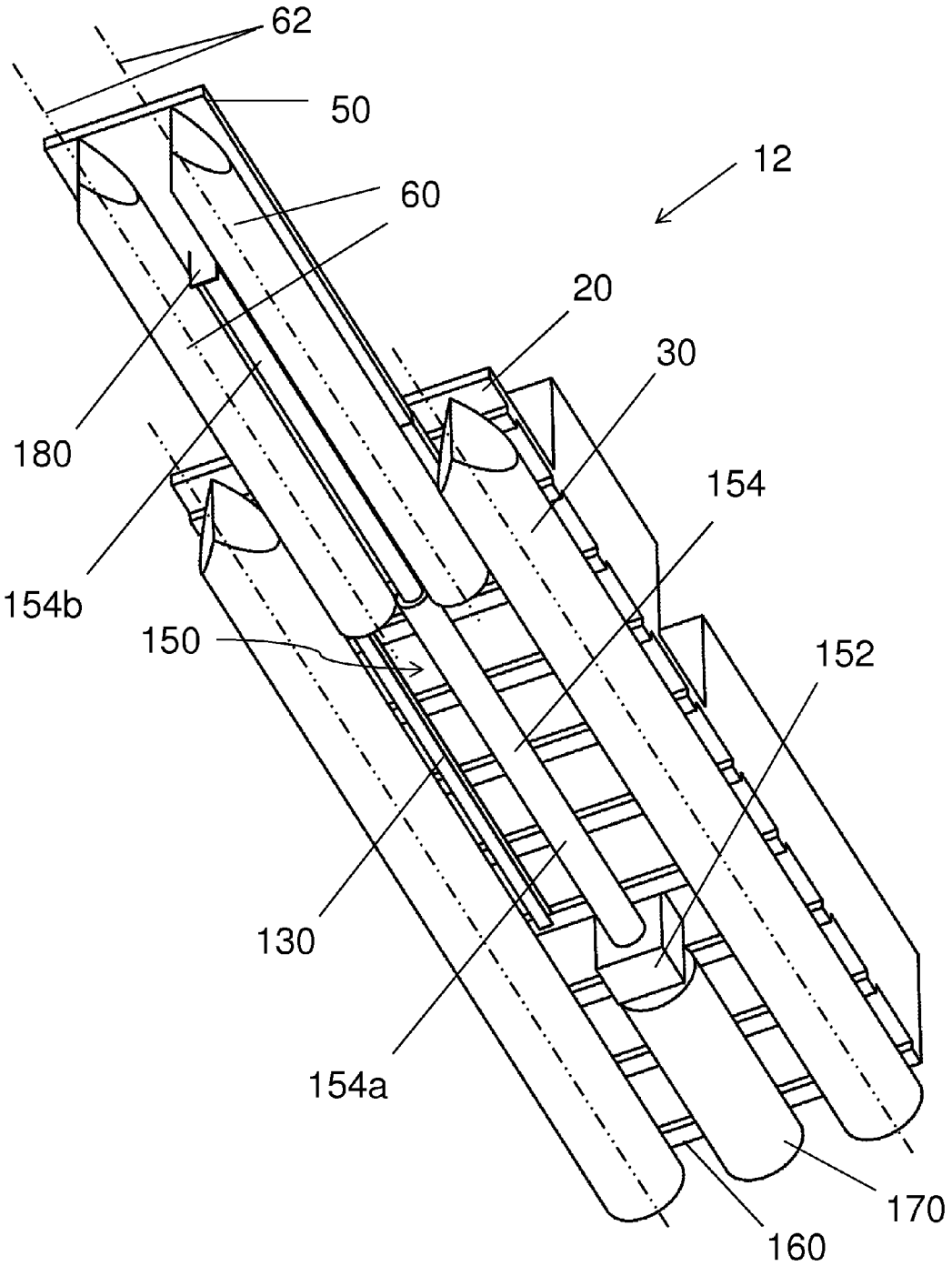
FIG. 6 is an upward isometric view of an embodiment of the pontoon boat of the present invention in the extended position with an actuator system.

The guide rails 40 generally described above are preferably formed from a pair of C-channels 130 as shown in FIG. 6 that are permanently mounted on the bottom side 20 of the main deck 10 between the flotation devices of a support structure. The C-channels are mounted parallel to each other and the abeam pontoons 30 with their open sides facing amidships toward each other. The C-channel spans the length of the lower deck. The channel supports the lower deck and provides a sliding base for extending and retracting the lower deck. It will be appreciated that the guide can be a c-channel, an f-channel, or any other sliding channel, track, rail or other guide that is known to be used for holding and sliding one structure relative to another structure. A wide range of existing sliding mechanisms may work with the present invention, such as mechanisms described in U.S. Pat. Nos. 6,868,799, 5,085,165, 6,003,458, 6,874,440 and 7,028,632 which are hereby incorporated herein by reference.

Figure 7:
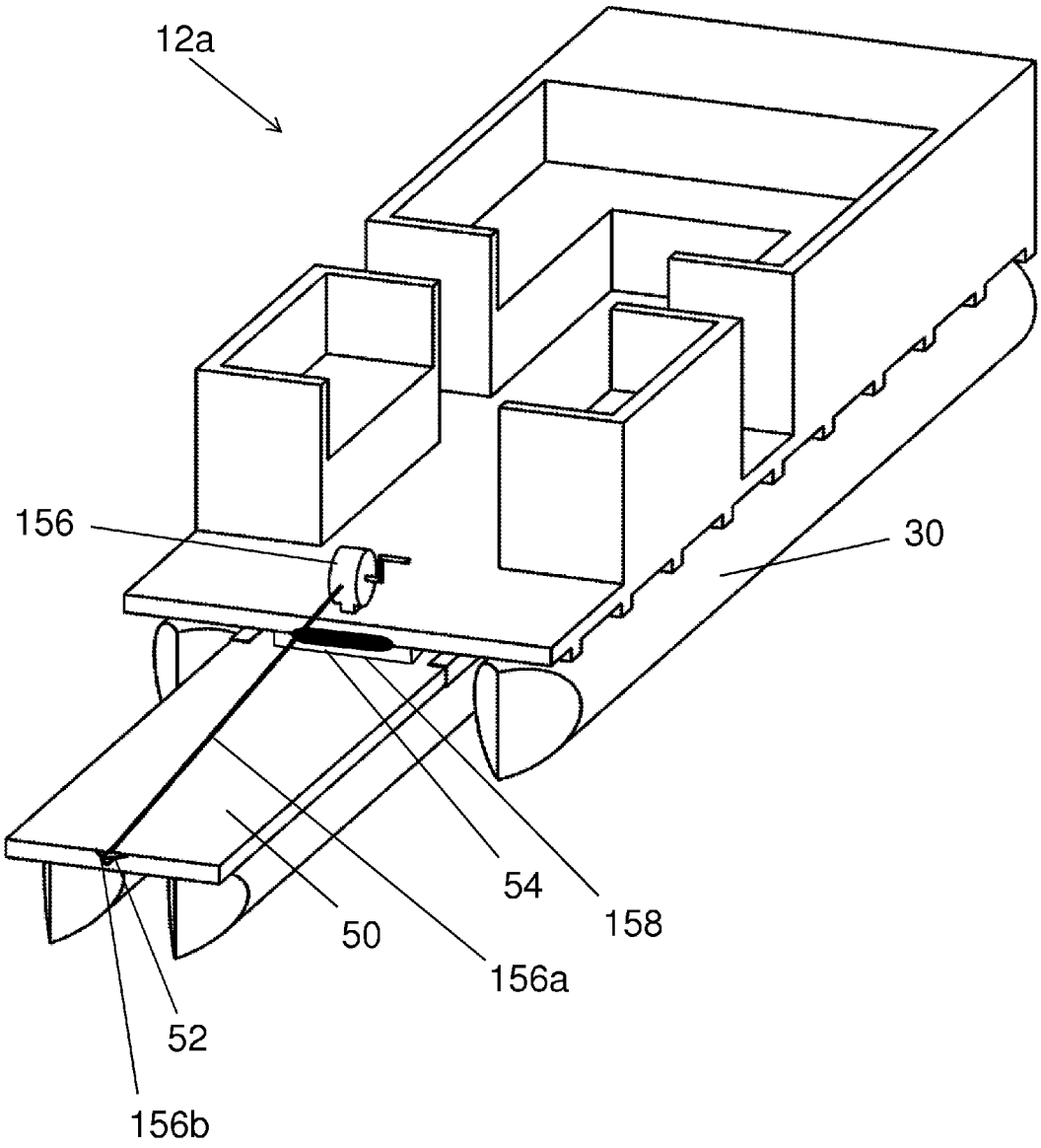
FIG. 7 is a downward isometric view of an embodiment of the pontoon boat of the present invention in the extended position with a manual winch.

Just as there are several options to connect the lower deck to the upper deck through various guide systems, there are different ways to actuate the lower deck and move it between its retracted and extended positions. Alternative actuator systems for moving the lower deck 50 relative to the upper deck 10 are shown in FIGS. 6 and 7 and may include various types of linear actuators 150, such as a screw and nut arrangement, a ram cylinder, a pneumatic cylinder, a hydraulic cylinder or a track gear. Generally, an electric motor 152 is used to power the actuator. For example a 12-volt motor with a forward and reverse drive can be used, and the motor can also have a neutral position. In one embodiment, the motor is mounted in front of the motor mount 170 at the stern 160 of the boat, between the abeam pontoons 30. In one embodiment, the screw can be rotated to force the threaded nut to move within a channel under either of the decks or an entire channel mounted under the deck can surround the screw.

In a preferred embodiment, the actuator 150 uses ram power, a telescoping hydraulic linear actuator 154 can have a fixed outer cylinder 154*a* and an inner rod 154*b* that extends from the outer cylinder. The outer cylinder is fixed to the upper deck structure, such as through attachment to the motor housing that is connected to the upper deck. The forward end of the inner rod is connected to a mount 180 that is fixedly attached to the bottom side of the lower deck. For a powered track/gear option, a notched track can be attached beneath the lower deck and extend back to a gear mounted to the motor. For example, the gear actuator could be mounted to the bottom side of the main deck structure adjacent to the side of the lower deck, and the gear would operate on a track that is mounted to the side of the lower deck. Whichever actuator system is used, it can be operated with a switch on the console or control panel of the watercraft, selecting between the forward, reverse and neutral operations. It will also be appreciated that it is possible to manually extend the secondary deck from its stowed position and then manually retract and lock the secondary deck in its stowed position.

In the preferred operation of the present invention, the lower deck is not designed with sufficient structural strength to accommodate powered travel along the water when the lower deck is fully or partially extended. Accordingly, there could be a propulsion power kill switch which prevents the watercraft's motor from being started while the lower deck is moved from its stowed position. It will also be appreciated that there could be a mechanical failure in the actuator system which prevents the powered retraction of the lower deck into its stowed position. Therefore, a manual actuator could also be provided with the secondary deck. For example, as shown in FIG. 7, in the event of a failure of the powered actuator system, a manual hand crank winch 156 with a winch cable 156*a* or strap and a hook 156*b* at the end may be latched to a bracket 52 mounted to the lower deck and manually operated to retract the lower deck. As particularly shown in FIG. 7, the hook engages a U-bolt at the bow of the lower deck. The actuator operation can be switched to neutral to manually crank in the lower deck, and there may also be an override of the motor kill switch. When the lower deck is in its fully extended position, a portion of the lower deck will remain under the upper deck and secured between the guide rails to ensure the stability and structural integrity of the watercraft at its main stress points. A limit switch on the actuator can prevent the lower deck from extending past the limit of its fully extended position. Additionally, there can be a failsafe physical stop 54 connected to the lower deck that cannot extend past a hard stop 158 fixed to the main deck to ensure that the lower deck will not exceed its limits.

Figure 8A:
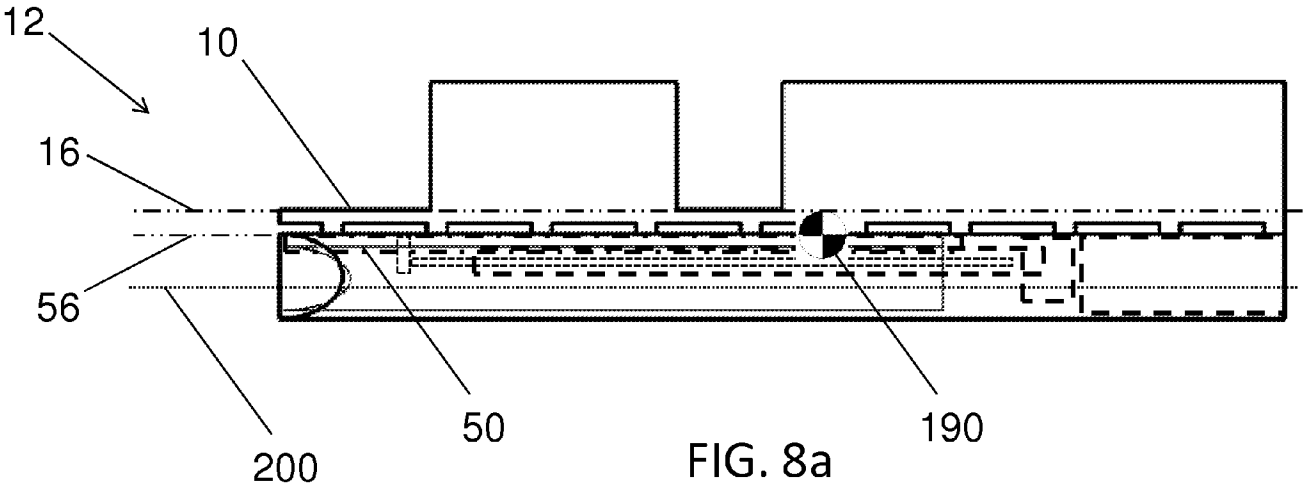
FIGS. 8*a* and 8*b* are port side views of an embodiment of the pontoon boat of the present invention in the stowed and extended positions, respectively.
Figure 8B:
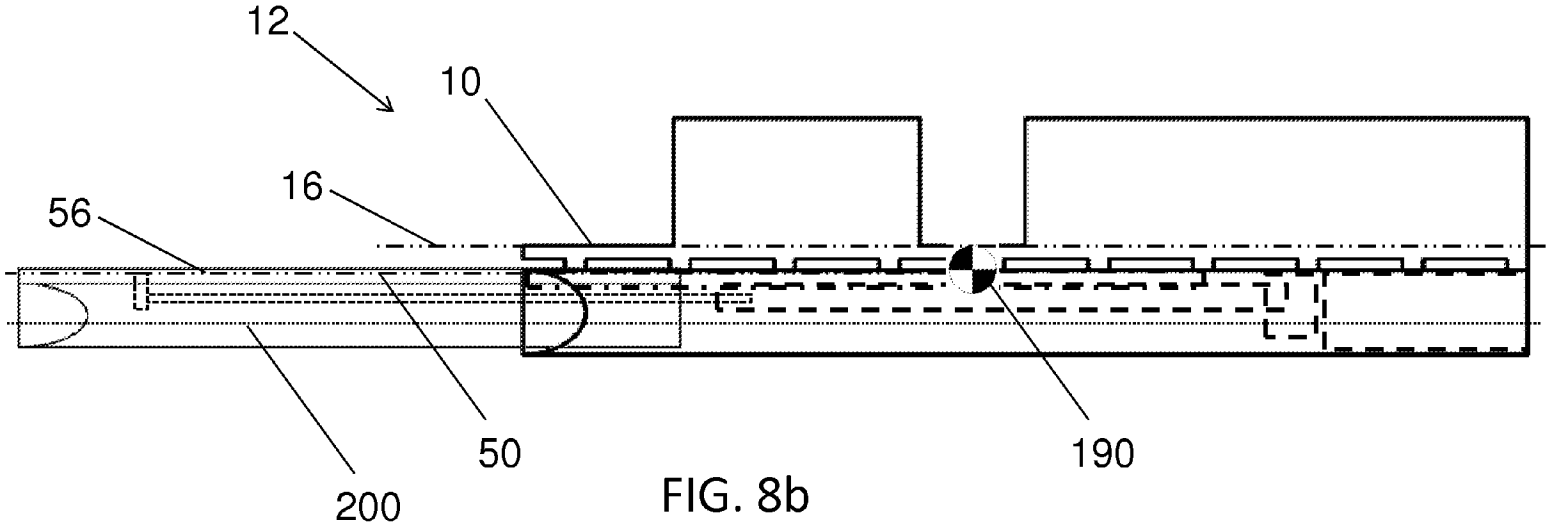

The overall buoyancy of the watercraft 12 does not vary depending on whether the lower deck retracted in its stowed position beneath the upper deck or is extended out from the upper deck, but as shown in FIGS. 8*a* and 8*b* the center of buoyancy and the center of gravity of the watercraft 190 shift towards the bow 140 of the watercraft as the lower deck is extended. Accordingly, the size and shape of the amidships pontoons are preferably selected to buoyantly support the entire weight of the lower deck at approximately the same level above the waterline as the level of the guide rails. When there is sufficient buoyancy in the amidships pontoons to support the lower deck at approximately the same level above the waterline 200 as the guide rails, the lower deck is buoyantly neutral to the overall buoyancy of the watercraft so there is no variation in the watercraft's attitude when the lower deck is moved between the stowed and extended positions. When there is slightly less buoyancy in the amidships pontoons than the weight of the lower deck, the change in the location of the center of gravity would move forward slightly farther than the center of buoyancy when the lower deck is fully extended which could cause the watercraft to assume a slight bow-down attitude as compared to the attitude when the lower deck is stowed. Similarly, the amidships pontoons should not greatly exceed the weight of the lower deck because this could cause a slight bow-up attitude when the lower deck is extended. When the amidships pontoons provide neutral buoyancy relative to the waterline level of the guide rails, the plane 56 of the secondary deck 50 remains substantially horizontal and parallel to the plane 16 of the main deck 10 as it moves from the stowed position to the fully extended position.

According to the present invention, the lower deck and its guide and actuator systems could be specially designed and produced with new watercraft. Alternatively, the lower deck and its accompanying systems could be designed for retrofitting existing watercraft, regardless of the age of the watercraft or the brand of watercraft. By retrofitting existing watercraft, older pontoon boats can be updated for weight capacity, horsepower and other improvements without the expense of an entirely new boat. With a standard size pontoon, there is approximately one hundred pounds (100 lbs) of buoyancy per linear foot of the additional amidships pontoons. For example, an improvement of a standard twenty-four foot (24 ft) pontoon boat according to the present invention could add as much as thirty-two hundred pounds (3,200 lbs) of buoyancy to a standard pontoon boat, and a standard tritoon conversion could add as much as one thousand pounds (1,000 lbs) of buoyancy. As discussed above, the increased buoyancy of the amidships pontoons should be at least as much as is required to maintain the weight of the lower deck in approximately the same waterline when it is extended as when it is stowed.

Figure 9A:
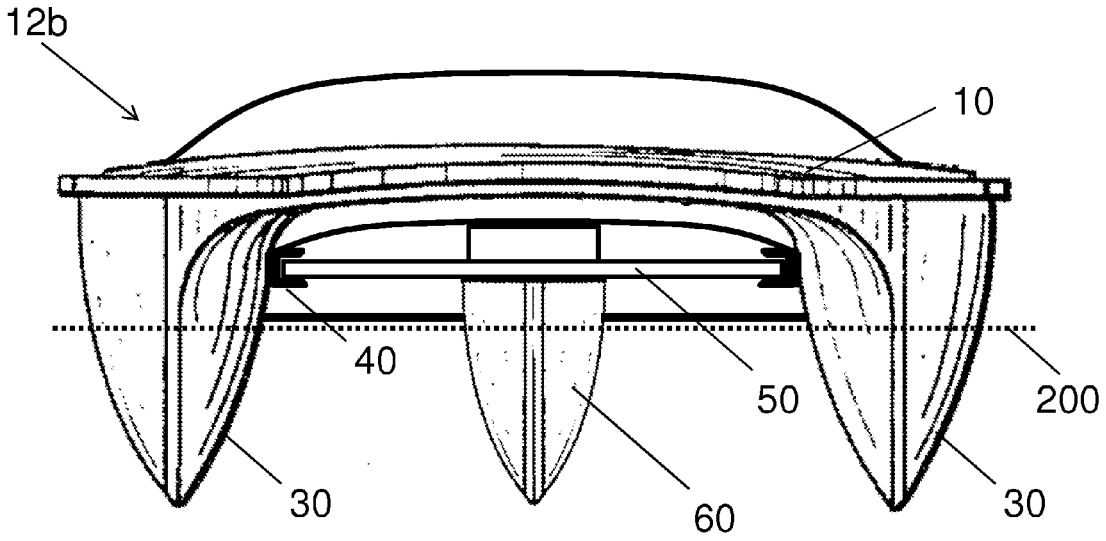
FIG. 9*a* is a bow end view of an embodiment of the catamaran boat of the present invention.
Figure 9B:
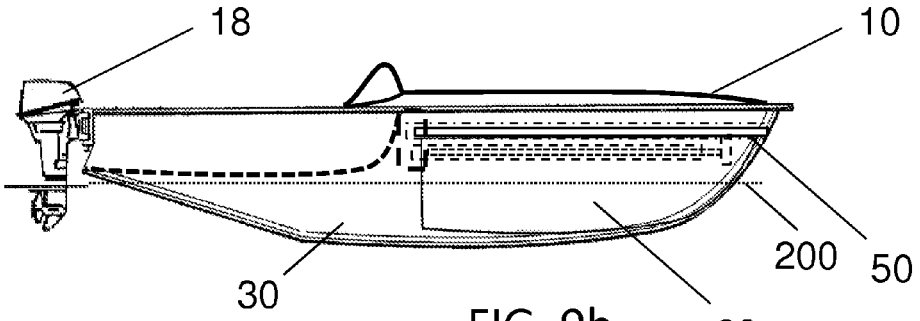
FIGS. 9*b* and 9*c* are starboard side views of the boat shown in FIG. 9*a* in the stowed and extended positions, respectively.
Figure 9C:
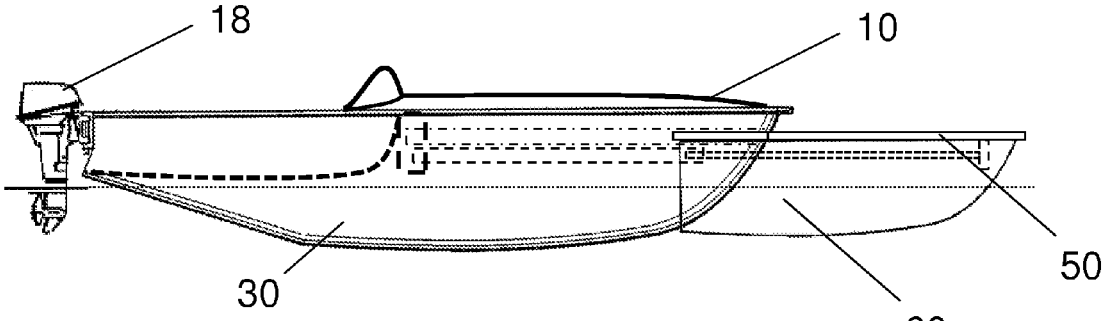
Figure 10:
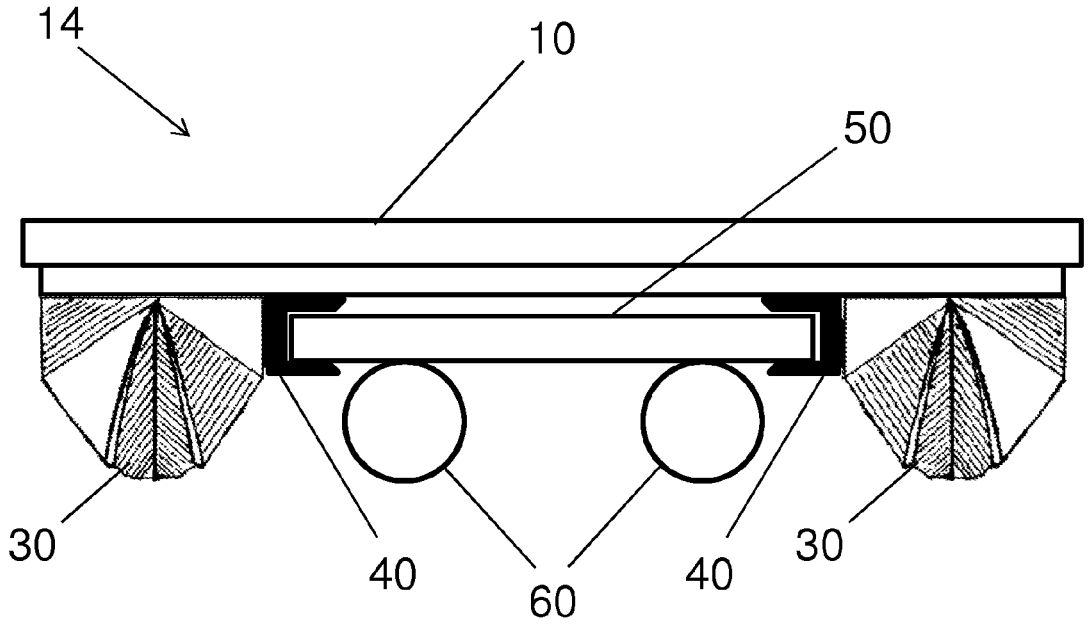
FIG. 10 is a front view of an embodiment of the main deck and secondary deck of the present invention.

It will be appreciated that the present invention can be used with any multi-deck, multihull watercraft 12 as well as other floating multi-deck platforms and structures 14. An example of a triple-hulled catamaran 12*b*, a trimaran, is shown in FIGS. 9*a*, 9*b* and 9*c* to have an extendable lower deck 50 and center hull 60, and an example of a main deck 10 with an extendable lower deck is shown in FIG. 10 for the floating multi-deck platform 14. Accordingly, the flotation devices can be any type of floats that may satisfy a particular design, such as pontoons for a pontoon boat 12*a*, hulls for a catamaran boat, buoys for a house boat, a floating dock, a mooring platform or any other anchored floating raft. With regard to the trimaran, it can be a motor boat with an outboard motor 18 as shown in the illustrations or may be a sailboat. With regard to docks 14 in particular, it will be appreciated that the lower deck and its accompanying systems as described herein and recited in the claims can be connected to a floating dock or any other type of a stationary dock, including a permanent dock supported by piers. For a dock on piers, it will be appreciated that there is a space for the lower deck between the piers beneath the bottom of the dock and the water under the dock which may vary with tides or the height of a lake. Therefore, the lower deck can have lengths and widths of various sizes to accommodate different upper deck sizes that may be found in house boats, pontoon boats, tritoon boats and any other multihull watercraft or dock.

As shown in the drawings, the bow end of the lower deck and its amidships pontoons are relatively flush with the bow end of the upper deck and the abeam pontoons, respectively, when they are in their retracted positions. However, it will be appreciated that the retracted positions of the lower deck or its amidships pontoons may be slightly recessed from the upper deck and its abeam pontoons. Alternatively, the retracted positions of the lower deck or the amidships pontoons may be slightly extended from the upper deck and the abeam pontoons. The recessed lower deck and pontoon arrangement may be particularly beneficial for permanent docks where owners must comply code restrictions and association restrictions for the size of floating docks and even permanent ground-supported docks, such as the pier dock described above. The slightly extended lower deck and pontoon arrangement could be as much as approximately six inches or more and may be beneficial to improve maneuverability and turning radius of a watercraft.

When the lower deck is in the extended position, the lower deck is elevated above the surface of the water from about 10 to 20 inches. When the lower deck is used, the user is less likely to be splashed by waves. Further, because of the longitudinal buoyancy provided by the amidships pontoons, the lower deck is extremely stable and safe.

According to the description of the embodiments above, it will be appreciated that the present invention provides several benefits over existing multihull vessels and floating docks. In particular, the present invention provides additional buoyancy that more than compensates for the increase in weight of the lower deck, the guides and the actuator system which increases the hauling capacity and gross vehicle weight of the multihull vessel. The present invention can also increase the maneuverability and stability of the multihull vessel as well as increase the useable deck space when the vessel is stationary. The present invention may also increase fuel economy of the vessel, especially when compared to a vessel with the same total useable deck space. When the invention is used with permanent dock structures, it increases the usable deck space.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. An extendable multihull boat, comprising:

a main deck having a top side, a bottom side, a deck length, a deck width and a bow;

a pair of abeam hulls located beneath said main deck and fixedly connected to said bottom side of said main deck, wherein said abeam hulls longitudinally span said deck length;

a pair of longitudinally elongated guide rails fixedly connected to said bottom side of said main deck between said abeam hulls; and a secondary deck below said bottom side of said main deck, wherein said secondary deck has a length and a width and is slidably connected to said pair of elongated guide rails between said pair of abeam hulls, wherein said secondary deck has a stowed position and a fully extended position, wherein said secondary deck is substantially beneath said main deck in said stowed position and wherein said secondary deck extends forward of said bow of said main deck in said fully extended position;

an amidships hull located beneath said secondary deck and fixedly connected to said secondary deck through a plurality of fasteners, wherein said amidships hull moves with said secondary deck between said stowed position and said fully extended position, wherein said amidships hull is longitudinally arranged between said abeam hulls in said stowed position and longitudinally extends forward of said abeam hulls in said fully extended position, wherein said fasteners form a permanent attachment between said secondary deck and said amidships hull, wherein said fasteners maintain said amidships hull in a fixed position relative to said secondary deck when said amidships hull and said secondary deck are in said stowed position and in said fully extended position, and wherein said amidships hull provides buoyant support to said secondary deck in said stowed position and in said fully extended position.

2. The extendable multihull boat of claim 1, wherein said top side of said main deck is in a first plane and wherein said secondary deck is in a second plane, wherein said second plane is substantially parallel to said first plane when said secondary deck is in said stowed position and in said fully extended position, wherein said length of said secondary deck extends between an aft section and a bow section, wherein said width of said secondary deck extends from a starboard side to a port side, wherein a first set of said fasteners are spaced between said aft section and said bow section and form a plurality of permanent attachments between said secondary deck and said amidships hull on said starboard side, and wherein a second set of said fasteners are spaced between said aft section and said bow section and form a plurality of permanent attachments between said secondary deck and said amidships hull on said port side.

3. The extendable multihull boat of claim 1, wherein said fasteners are selected from the group consisting of bolts, brackets, welds, screws, rivets, and any combination thereof, wherein all of said fasteners maintaining said amidships hull in said fixed position relative to said secondary deck are located beneath said main deck when said amidships hull and said secondary deck are in said stowed position, wherein a first set of said fasteners maintaining a first portion of said amidships hull in said fixed position relative to said secondary deck extend out from underneath said main deck with said first portion in said fully extended position, and wherein a second set of fasteners maintaining a second portion of said amidships hull in said fixed position relative to said secondary deck remain underneath said main deck with said second portion in said fully extended position.

4. The extendable multihull boat of claim 1, wherein said length of said secondary deck is at least approximately 30% of said deck length of said main deck.

5. The extendable multihull boat of claim 1, wherein said secondary deck further comprises a pair of longitudinally elongated foldable wings, wherein said elongated foldable wings laterally rotate between a closed position and an open position.

6. The extendable multihull boat of claim 1, wherein said main deck further comprises a rotatable hinge plate extending from a front face of said main deck to a top side of said secondary deck.

7. The extendable multihull boat of claim 1, wherein said guide rails are located at a level above a waterline, and wherein said amidships hull buoyantly supports said secondary deck at said level above said waterline with substantially neutral buoyancy and wherein an attitude of said main deck remains substantially equal when said secondary deck moves between said stowed position and said fully extended position.

8. The extendable multihull boat of claim 1 further comprising an actuator system with a fixed section mounted to said main deck and a moving section mounted to said secondary deck, wherein said actuator system moves said secondary deck between said stowed position and said fully extended position.

9. The extendable multihull boat of claim 8, wherein each of said abeam hulls is comprised of an abeam pontoon, wherein said amidships hull is further comprised of a pair of amidships pontoons, and wherein said elongated guide rails are comprised of c-channels.

10. The extendable multihull boat of claim 8, wherein said actuator is comprised of a hydraulic linear actuator and an electric motor, wherein said hydraulic linear actuator is comprised of an outer cylinder and an inner rod, wherein said outer cylinder is attached to said bottom side of said main deck and wherein a forward end of said inner rod is connected to said secondary deck.

11. A floating multi-deck platform for a watercraft, comprising an upper deck supported on a bottom side by a pair of longitudinally elongated abeam pontoons spanning said upper deck from an aft location of said upper deck to a bow side of said upper deck;

a pair of longitudinally elongated guides fixedly connected to said bottom side of said upper deck between said pair of elongated abeam pontoons;

a lower deck located beneath said upper deck, wherein said lower deck is slidably connected to said pair of elongated guides and is fixedly connected to a longitudinally elongated amidships pontoon through a plurality of fasteners, wherein said lower deck and said elongated amidships pontoon have a stowed position and a fully extended position, wherein said lower deck is substantially beneath said upper deck in said stowed position and extends forward of said bow side of said upper deck in said fully extended position, wherein said amidships pontoon is longitudinally arranged between said abeam pontoons in said stowed position and extends forward of said abeam pontoons in said fully extended position, wherein said fasteners form a permanent attachment between said lower deck and said amidships pontoon, wherein said fasteners hold said amidships pontoon in a fixed position relative to said lower deck when said amidships pontoon and said lower deck are in said stowed position and in said fully extended position, and wherein said amidships pontoon provides buoyant support to said secondary deck in said stowed position and in said fully extended position; and an actuator system with a fixed section mounted to said upper deck and a moving section mounted to said lower deck, wherein said actuator moves said lower deck between said stowed position and said fully extended position.

12. The multi-deck platform of claim 11, wherein a length of said amidships pontoon is at least 75% of a deck length of said lower deck.

13. The multi-deck platform of claim 11, wherein said lower deck further comprises a pair of longitudinally elongated foldable wings, wherein said elongated foldable wings laterally rotate between a closed position and an open position.

14. The multi-deck platform of claim 11, wherein said elongated guides are located at a level above a waterline, and wherein said amidships pontoon buoyantly supports said lower deck at said level above said waterline with substantially, neutral buoyancy, wherein an attitude of said upper deck remains substantially equal when said lower deck moves between said stowed position and said fully extended position, wherein said lower deck extends from a starboard side to a port side between an aft section and a bow section, wherein all of said fasteners holding said amidships pontoon in said fixed position relative to said lower deck are located beneath said upper deck when said amidships pontoon and said lower deck are in said stowed position, wherein a first set of said fasteners holding a first portion of said amidships pontoon in said fixed position relative to said lower deck extend out from underneath said upper deck with said first portion in said fully extended position, and wherein a second set of fasteners holding a second portion of said amidships pontoon in said fixed position relative to said lower deck remain underneath said upper deck with said second portion in said fully extended position.

15. The multi-deck platform of claim 14 further comprising of a pair of amidships pontoons, wherein said fasteners are selected from the group consisting of bolts, brackets, welds, screws, rivets, and any combination thereof, wherein said elongated guides are comprised of c-channels, wherein said actuator system is comprised of a hydraulic linear actuator and an electric motor, wherein said hydraulic linear actuator is comprised of an outer cylinder and an inner rod, wherein said outer cylinder is attached to said bottom side of said upper deck and wherein a forward end of said inner rod is connected to said lower deck.

16. The multi-deck platform of claim 11 further comprising an outboard motor connected to said upper deck.

17. A floating deck system for connection to the bottom side of an upper deck, comprising:

a pair of longitudinally elongated guides attached to the bottom side of the upper deck, wherein said elongated guides are located at a guide level above a waterline;

a lower deck below the bottom side of the upper deck, wherein said lower deck is slidably connected to said pair of elongated guides, wherein said lower deck has a stowed position and a fully extended position, wherein said lower deck is substantially beneath the upper deck in said stowed position, and wherein a front side of said lower deck extends forward of the upper deck in said fully extended position and a back side of said lower deck remains beneath the upper deck when said front side is in said fully extended position;

an amidships pontoon located beneath said lower deck and fixedly connected to said lower deck through a plurality of fasteners, wherein said amidships pontoon moves with said lower deck between said stowed position and said fully extended position, wherein said fasteners form a permanent attachment between said lower deck and said amidships pontoon, wherein said fasteners hold said amidships pontoon in a fixed position relative to said lower deck when said amidships pontoon and said lower deck are in said stowed position and in said fully extended position, and wherein said amidships pontoon provides a buoyant support to said secondary deck in said stowed position and in said fully extended position, and wherein said buoyant support maintains said lower deck at said guide level above said waterline with substantially neutral buoyancy; and an actuator system with a fixed section mounted to the upper deck and a moving section mounted to said lower deck, wherein said actuator moves said lower deck between said stowed position and said fully extended position.

18. The floating deck of claim 17, further comprising a pair of longitudinally elongated abeam flotation devices attached to the bottom side of the upper deck on opposite sides of said lower deck, wherein said abeam flotation devices are selected from the group of floats consisting of a pair of pontoons supporting a pontoon boat, a pair of hulls supporting a catamaran boat, a pair of buoys supporting at least one of a house boat, a floating dock, a mooring platform and a floating raft, and wherein an attitude of the upper deck remains substantially equal when said lower deck moves between said stowed position and said fully extended position.

19. The floating deck of claim 17, wherein said lower deck further comprises a pair of longitudinally elongated foldable wings, wherein said elongated foldable wings laterally rotate between a closed position and an open position.

20. The floating deck of claim 17, wherein said fasteners are selected from the group consisting of bolts, brackets, welds, screws, rivets, and any combination thereof, wherein said fasteners form a first set of permanent attachments between said front side of said lower deck and said amidships pontoon and a second set of permanent attachments between said back side of said lower deck and said amidships pontoon, wherein said first set of permanent attachments and said second set of permanent attachments are all located beneath the upper deck in said stowed position, wherein said first set of permanent attachments extend out from beneath the upper deck in said fully extended position, and wherein said second set of permanent attachments remain beneath the upper deck in said fully extended position.

* * * * *